US010272489B2

(12) United States Patent
Nishida et al.

(10) Patent No.: US 10,272,489 B2
(45) Date of Patent: Apr. 30, 2019

(54) CARRIAGE FOR RECEIVING MOLTEN METAL WITH A MECHANISM FOR MOVING A LADLE UP AND DOWN, AND A METHOD FOR TRANSPORTING MOLTEN METAL

(71) Applicants: SINTOKOGIO, LTD., Nagoya-shi, Aichi (JP); FUJIWA DENKI CO., LTD., Nagoya-shi, Aichi (JP)

(72) Inventors: Tadashi Nishida, Nagoya (JP); Masanori Hoshino, Nagoya (JP)

(73) Assignees: SINTOKOGIO, LTD., Aichi (JP); FUJIWA DENKI CO., LTD., Aichi (JP)

( * ) Notice: Subject to any disclaimer, the term of this patent is extended or adjusted under 35 U.S.C. 154(b) by 26 days.

(21) Appl. No.: 15/504,204

(22) PCT Filed: Sep. 17, 2014

(86) PCT No.: PCT/JP2014/074489
§ 371 (c)(1),
(2) Date: Feb. 15, 2017

(87) PCT Pub. No.: WO2016/042609
PCT Pub. Date: Mar. 24, 2016

(65) Prior Publication Data

US 2017/0232507 A1 Aug. 17, 2017

(51) Int. Cl.

| | |
|---|---|
| ***B22D 41/12*** | (2006.01) |
| ***F27D 3/06*** | (2006.01) |
| ***F27D 3/12*** | (2006.01) |
| *F27D 3/00* | (2006.01) |

(52) U.S. Cl.
CPC ..... *B22D 41/12* (2013.01); *F27D 3/06* (2013.01); *F27D 3/123* (2013.01);
(Continued)

(58) Field of Classification Search
CPC ..... B22D 41/12; F27D 2003/0086; F27D 2003/0091; F27D 2003/125; F27D 2003/127; F27D 3/06; F27D 3/123
(Continued)

(56) References Cited

U.S. PATENT DOCUMENTS 9,289,824 B2 * 3/2016 Banno ..... B22D 39/04

FOREIGN PATENT DOCUMENTS

CN 201505718 U 6/2010
CN 102019418 A 4/2011
(Continued)

OTHER PUBLICATIONS

English-language International Search Report from the Japanese Patent Office for International Application No. PCT/JP2014/074489, dated Oct. 28, 2014.
(Continued)

*Primary Examiner* — Jessee R Roe
*Assistant Examiner* — Michael Aboagye
(74) *Attorney, Agent, or Firm* — Finnegan, Henderson, Farabow, Garrett & Dunner, LLP

(57) ABSTRACT

A carriage for receiving molten metal with a mechanism for moving a ladle up and down and a method for transporting molten metal to safely move a ladle for receiving a molten metal up and down and transport it. The carriage (10) for receiving molten metal to transport the ladle that receives molten metal from a furnace (C) comprises a carriage (20) for travelling on a route (L), guiding columns (30) that are placed on the carriage (20), a frame (40) that horizontally extends from the guiding columns and moves up and down above the carriage (20), a mechanism (50) for moving the ladle, which mechanism is placed on the frame (40) and horizontally moves the ladle, and the driver (60) for moving the frame up and down.

7 Claims, 10 Drawing Sheets

(52) U.S. Cl.
CPC ..... *F27D 2003/0086* (2013.01); *F27D 2003/0091* (2013.01); *F27D 2003/125* (2013.01); *F27D 2003/127* (2013.01)

(58) Field of Classification Search
USPC ..... 266/44, 45, 236, 276; 164/4.1, 457, 130, 164/154, 155, 136, 323, 337; 222/591, 222/604; 212/273, 319
See application file for complete search history.

(56) References Cited

FOREIGN PATENT DOCUMENTS

| | | | |
|---|---|---|---|
| CN | 102271839 | A | 12/2011 |
| CN | 102883838 | A | 1/2013 |
| JP | 61-243112 | | 10/1986 |
| JP | 04-71774 | | 3/1992 |
| JP | H04-094147 | | 8/1992 |
| JP | H09-271933 | | 10/1997 |
| JP | 2004-169082 | | 6/2004 |
| JP | 2012-525977 | | 10/2012 |
| WO | WO 2010/122900 | | 10/2010 |

OTHER PUBLICATIONS

Chinese Office Action issued by the Chinese Patent Office in corresponding Application No. 201480075463.2, dated Apr. 27, 2018.
Office Action issued by the Japanese Patent Office in corresponding Application No. 2016-561133, dated Jul. 24, 2018.

* cited by examiner

CARRIAGE FOR RECEIVING MOLTEN METAL WITH A MECHANISM FOR MOVING A LADLE UP AND DOWN, AND A METHOD FOR TRANSPORTING MOLTEN METAL

TECHNICAL FIELD

The present invention relates to a carriage for receiving molten metal and a method for transporting molten metal, so as to transport a ladle that receives molten metal from a furnace. Especially, it relates to a carriage for receiving molten metal with a mechanism for moving a ladle up and down, and a method for transporting molten metal with a ladle being moved up and down.

BACKGROUND ART

In a foundry, cast products are manufactured by transporting molten metal at a high temperature that has been melted in a melting furnace or the like to a system for pouring the molten metal and by pouring the molten metal into molds by means of the system for pouring the molten metal. Conventionally, to transport molten metal from a melting furnace to a system for pouring the molten metal, the molten metal is received by a ladle. Then the ladle is transported to the system for pouring the molten metal by means of a crane. However, when the ladle that contains molten metal at a high temperature is transported by a crane, there are problems such that an operator must approach the high temperature molten metal, and such that the ladle that is suspended by the crane may accidentally fall.

Thus, a method for transporting the ladle by using a travelling carriage or a roller conveyor came to be adopted (see International Publication No. WO 2010/122900). However, a foundry is generally very large, and so the time when the melting furnace or the holding furnace is installed may differ from the time when the system for pouring the molten metal is installed. So, the site of most foundries is not flat. Therefore the height for receiving molten metal often differs from that for pouring it. Thus, to accommodate the possible difference in heights, a carriage for transporting a ladle is required to be equipped with a mechanism for moving the ladle up and down. That ladle is used for transferring the molten metal from a ladle for receiving the molten metal to a ladle for pouring it.

When a foundry is renovated the height of the site of the melting furnace is often used for a basis for the height. In this case the height where the ladle is transported or the molten metal is poured into molds may be lower than the height where the ladle receives the molten metal. Thus, it is preferable to move up and down the ladle for receiving molten metal from the melting furnace and the like. However, since the melting furnace is at a high temperature, a system that is susceptible to heat should be prevented from approaching the melting furnace.

The present invention aims to provide a carriage for receiving molten metal with a mechanism for moving a ladle up and down and a method for transporting molten metal, so as to safely move the ladle for receiving the molten metal up and down and so as to safely transport it.

DISCLOSURE OF INVENTION

A carriage 10 for receiving molten metal with a mechanism for moving a ladle up and down of the first aspect of the present invention, for example, as shown in FIGS. 1 and

2, wherein the carriage 10 for receiving molten metal transports the ladle A for receiving molten metal, comprises a carriage 20 for travelling on a route L. It also comprises guiding columns 30 that are placed on the carriage 20 for travelling. It also comprises a frame 40 for moving up and down that horizontally extends from the guiding columns 30 and that moves up and down above the carriage 20 for travelling. It also comprises a mechanism 50 for moving the ladle, which mechanism is placed on the frame 40 and horizontally moves the ladle A. It also comprises a driver 60 for moving the frame 40 up and down.

By this configuration, since the ladle that has received the molten metal is moved up and down by means of the frame, leveling the pouring level and the level for receiving the molten metal is facilitated. Further, since the ladle can be brought by means of the mechanism for moving the ladle close to the furnace while it is moved up by means of the frame, the ladle can receive molten metal from the melting furnace or the like without preventing any other devices, such as the driver for moving the frame up and down, from approaching the melting furnace or the like.

By the carriage 10 for receiving molten metal with a mechanism for moving a ladle up and down of a second aspect of the present invention, for example, as shown in FIGS. 4 to 7, in the carriage 10 for receiving molten metal of the first aspect, the frame 40 has two holding rollers 44, which are disposed with a vertical space therebetween. A guiding device 32 for the rollers that has a vertical surface, on which the holding rollers roll, is provided to each of the guiding columns 30.

By this configuration, a moment that is generated in the frame that supports the ladle is supported by forces that the two holding rollers that are disposed with a vertical space therebetween receive from the surface of the guiding device.

By the carriage 10 for receiving molten metal with a mechanism for moving a ladle up and down of a third aspect of the present invention, for example, as shown in FIGS. 2 to 5, in the carriage 10 for receiving molten metal of the second aspect, the frame 40 is suspended at two locations by chains 66. The driver 60 for moving the frame up and down moves the frame 40 up and down by means of the chains 66.

By this configuration, since the frame is suspended at two locations by the chains, it is well balanced. Further, since it is suspended by the chains, nothing is placed below the frame, namely, below the ladle, safety would be maintained even if molten metal were to leak from the bottom of the ladle.

By the carriage 10 for receiving molten metal with a mechanism for moving a ladle up and down of a fourth aspect of the present invention, for example, as shown in FIG. 2, in the carriage 10 for receiving molten metal of the third aspect, a motor 62 of the driver 60 for moving the frame up and down is placed at a side that is opposite the frame 40 on the carriage 20 for travelling with respect to the guiding columns 30

By this configuration, since the motor of the driver for moving the frame up and down is placed at a location separate from the frame, i.e., the ladle, no molten metal would be poured on the motor even if some were to leak from the bottom of the ladle. Since the motor, which takes a long time to be repaired, is thus not damaged, any repairs can be easily carried out.

By the carriage 10 for receiving molten metal with a mechanism for moving a ladle up and down of a fifth aspect of the present invention, for example, as shown in FIG. 2, in the carriage 10 for receiving molten metal of the third aspect, the frame 40 has a load cell 48 to measure a weight of the ladle A.

By this configuration, since the weight that is measured by the load cell is that of the ladle, with minimum mechanical parts, that is, the weight of the frame is not included, the weight of the ladle is accurately measured.

By the carriage 10 for receiving molten metal with a mechanism for moving a ladle up and down of a sixth aspect of the present invention, for example, as shown in FIG. 2, in the carriage 10 for receiving molten metal of any of the first to fifth aspects, a device 70 for opening a cover is provided on the carriage 20 for travelling. The device 70 for opening a cover has a column 72 that is placed on the carriage 20 for travelling, an arm 74 that rotates about a center of the column 72 on a top thereof, and a device 76 for grasping a cover that is disposed at a tip of the arm 74.

By this configuration, since the device for opening a cover is placed on the carriage for travelling, the cover is placed immediately after receiving molten metal, and the cover is removed just before the molten metal is poured from the ladle, so that the temperature of the molten metal is maintained. Further, since the cover that has been removed from the ladle is moved by means of the arm, it can be moved out of the working area. Further, since a mechanism for moving the ladle up and down is provided, the vertical movement of the device for opening a cover is decreased so as to make the device for opening a cover smaller.

By the carriage 10 for receiving molten metal with a mechanism for moving a ladle up and down of a seventh aspect of the present invention, for example, as shown in FIG. 2, in the carriage 10 for receiving molten metal of the sixth aspect, the motor 62 of the driver 60 for moving the frame up and down and a motor 78 of the device 70 for opening a cover are located above a height of the bottom of the ladle A when the frame 40 is lowered.

By this configuration, since the motors are located above the height of the bottom of the ladle, no molten metal would be poured on the motors even if molten metal were to leak from the bottom of the ladle. Since no motor, any type of which takes a long time to be repaired, is damaged, any repairs can be easily carried out.

The carriage 10 for receiving molten metal with a mechanism for moving a ladle up and down of an eighth aspect of the present invention, for example, as shown in FIG. 9, in the carriage 10 for receiving molten metal of the seventh aspect, further comprises power-receiving equipment 80 that receives power from outside the carriage 10 for receiving molten metal and is located at a side that is opposite a furnace C that pours molten metal into the ladle A.

By this configuration, since the power-receiving equipment is placed at a location separate from the furnace, no heat from the furnace affects the power-receiving equipment.

A method for transporting molten metal of a ninth aspect of the present invention, for example, as is shown in FIGS. 1 to 9, wherein molten metal is poured from a furnace C to a ladle A on a carriage 10 for receiving molten metal, and wherein the ladle A, which has received molten metal, is transported by the carriage 10 for receiving molten metal, comprises the step of moving up the ladle A on the carriage 10 for receiving molten metal and bringing the ladle A close to the furnace C in a horizontal direction above the carriage 10 for receiving molten metal. It also comprises the step of receiving molten metal from the furnace C in the ladle A, which is brought close to the furnace C. It also comprises the step of moving down the ladle A that has received molten metal and then bringing the ladle A to a position where it is located away from the furnace C in a horizontal direction above the carriage 10 for receiving molten metal. It also comprises the step of causing the carriage 10 for receiving molten metal to travel so as to transport the ladle A, which has been lowered and placed away from the furnace C.

By this configuration, since the ladle is moved up and brought close to the furnace so as to receive molten metal and the ladle is then moved down and brought separately from the furnace so as to transport it, the method for transporting molten metal is safe and it is easy to receive molten metal in the ladle and to transport the ladle.

By the method for transporting molten metal of a tenth aspect of the present invention, for example, as shown in FIGS. 1 to 9, in the method of the ninth aspect, the furnace C has a capacity to pour molten metal into the ladle A multiple times, and either or both of a height of the ladle A and a distance from the furnace C to the ladle A in the step of receiving molten metal differ from the height or the distance in the step of receiving molten metal at a previous time.

By this configuration, when the amount of molten metal in the furnace changes so that the angle of the tilt of the furnace to pour the molten metal changes, the molten metal is poured into the ladle.

By the method for transporting molten metal of an eleventh aspect of the present invention, for example, as shown in FIGS. 1 to 9, in the method of the ninth or tenth aspect, molten metal is poured from the furnace C into the ladle A while either or both of the height of the ladle A and the distance from the furnace C to the ladle A are changed in the step of receiving molten metal.

By this configuration, when the amount of molten metal in the furnace changes so that the angle of the tilt of the furnace to pour the molten metal changes, the molten metal is poured into the ladle.

The present invention will become more fully understood from the detailed description given below. However, the detailed description and the specific embodiments are only illustrations of the desired embodiments of the present invention, and so are given only for an explanation. Various possible changes and modifications will be apparent to those of ordinary skill in the art on the basis of the detailed description.

The applicant has no intention to dedicate to the public any disclosed embodiment. Among the disclosed changes and modifications, those which may not literally fall within the scope of the present claims constitute, therefore, a part of the present invention in the sense of the doctrine of equivalents.

The use of the articles "a," "an," and "the" and similar referents in the specification and claims are to be construed to cover both the singular and the plural form of a noun, unless otherwise indicated herein or clearly contradicted by the context. The use of any and all examples, or exemplary language (e.g., "such as") provided herein is intended merely to better illuminate the invention, and so does not limit the scope of the invention, unless otherwise stated.

BEST MODE FOR CARRYING OUT THE INVENTION

Figure 1:
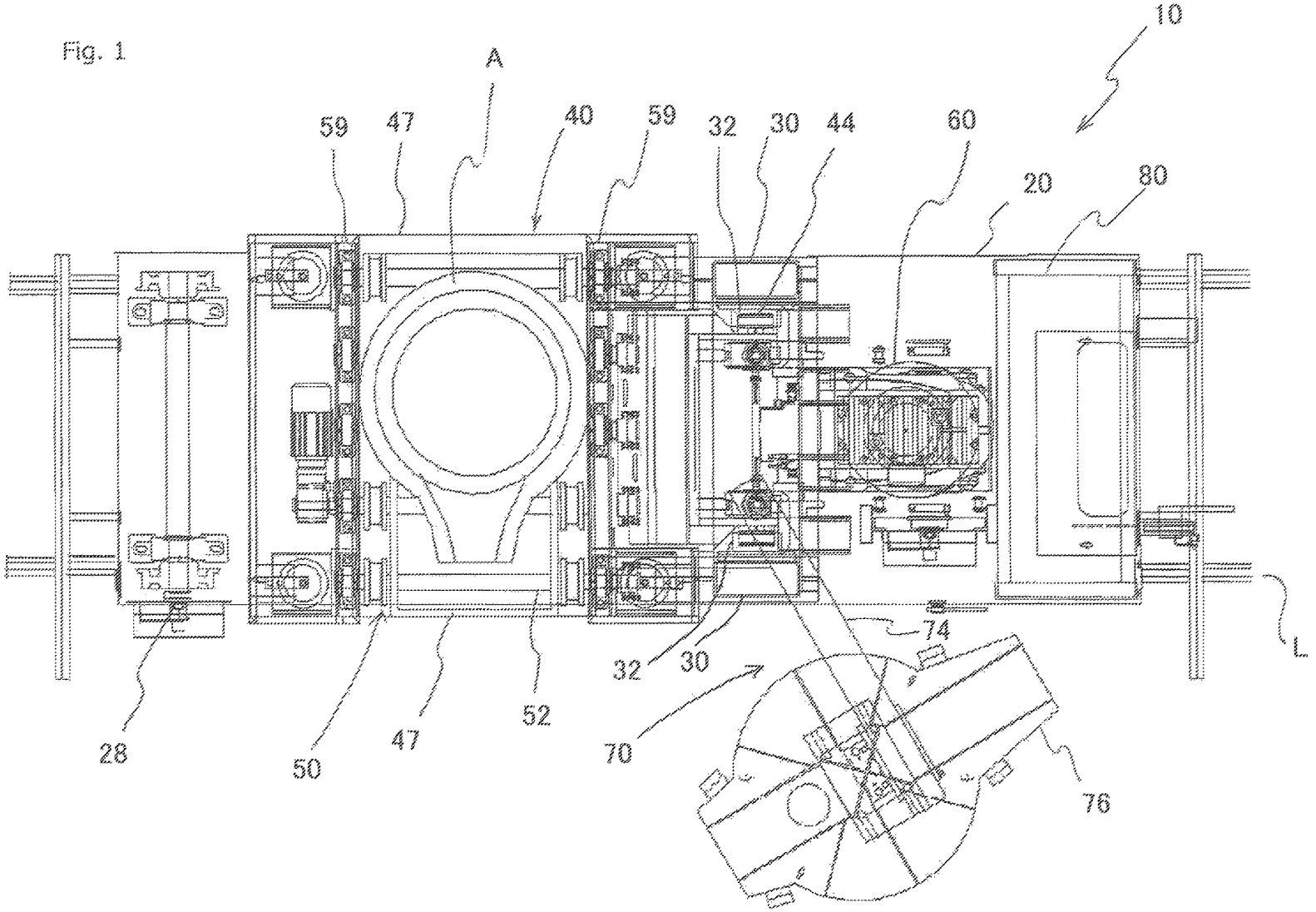
FIG. 1 shows a plan view of the carriage for receiving the molten metal with a mechanism for moving the ladle up and down, as an embodiment of the present invention.
Figure 2:
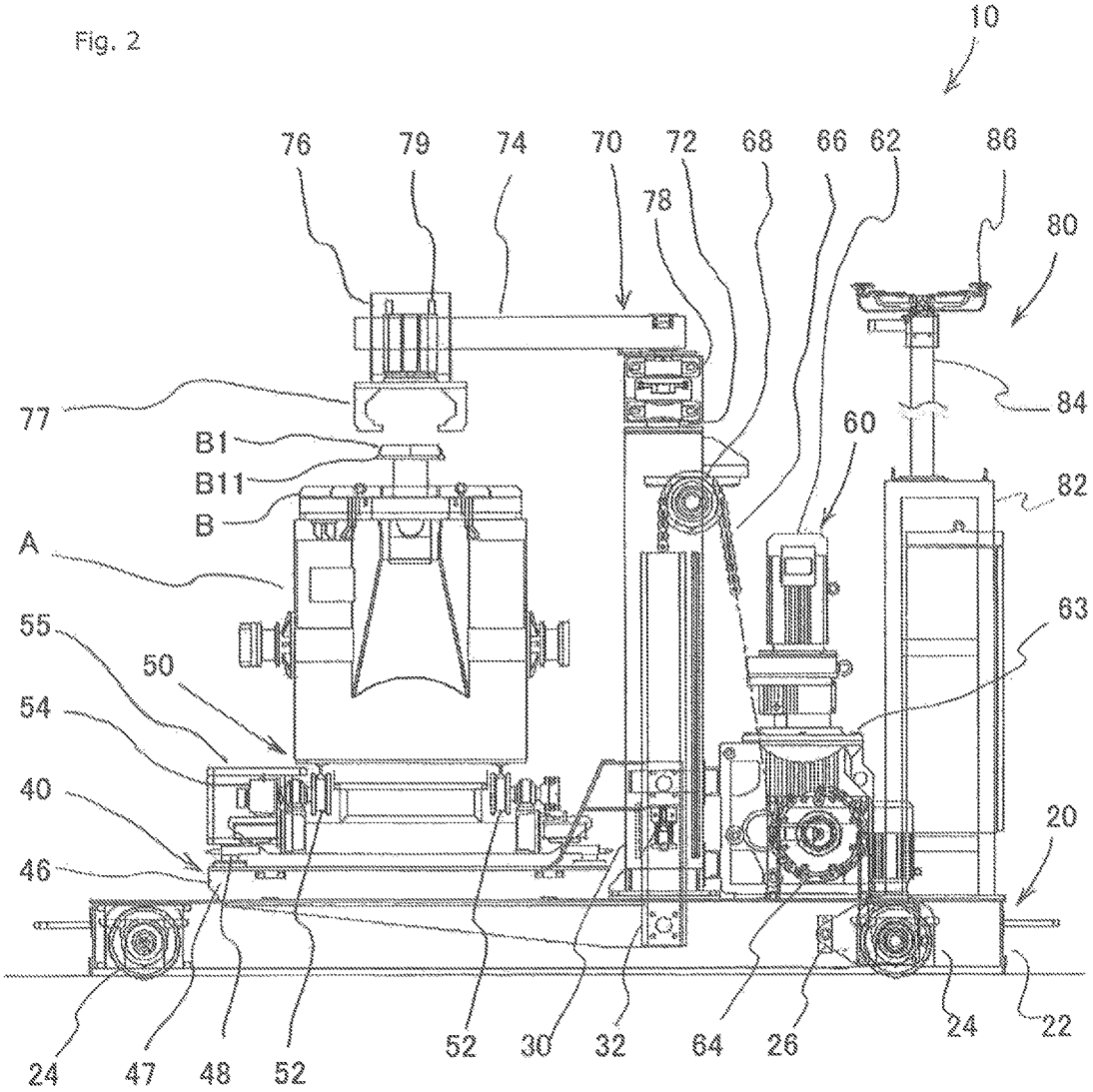
FIG. 2 shows a front view of the carriage for receiving the molten metal with a mechanism for moving the ladle up and down as in FIG. 1.
Figure 3:
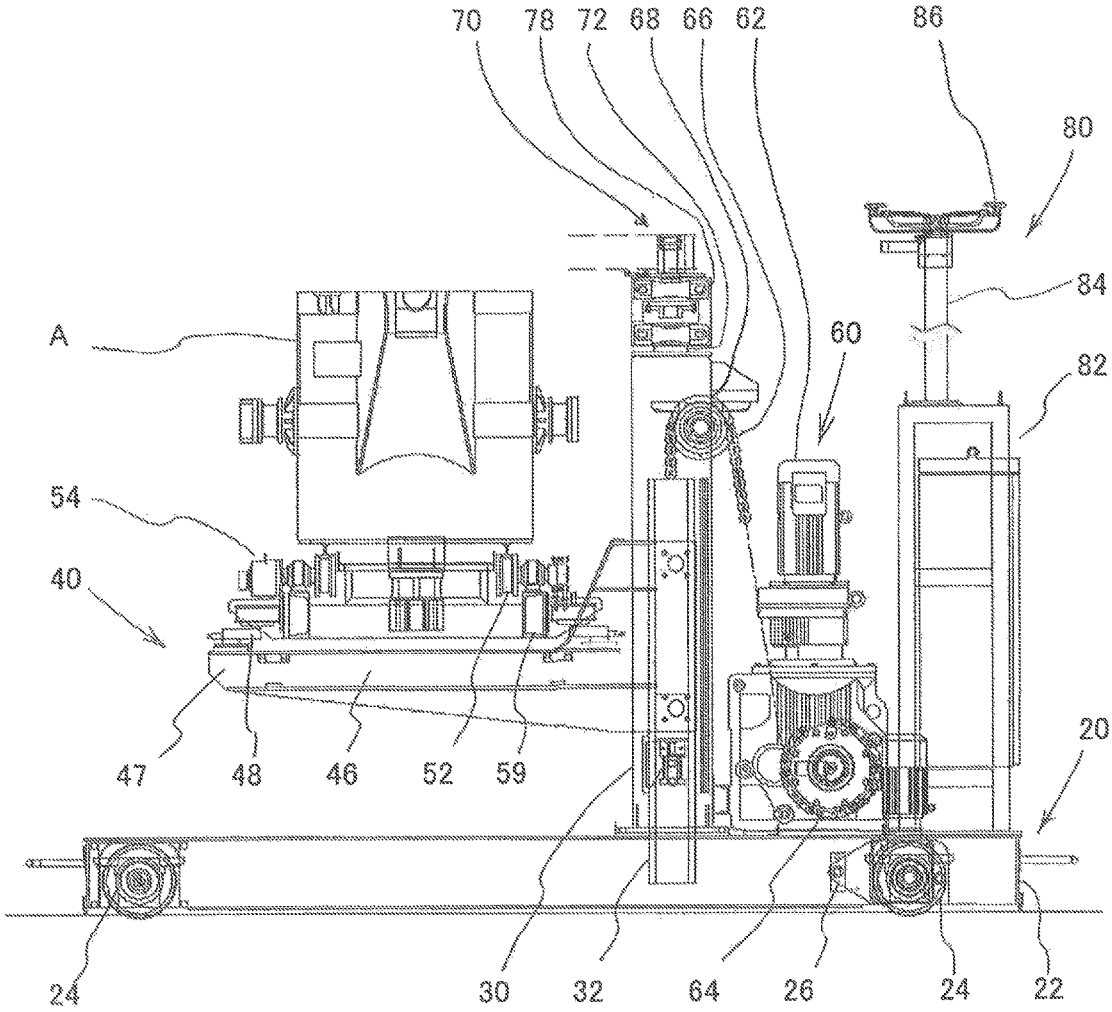
FIG. 3 shows the carriage for receiving the molten metal with a mechanism for moving the ladle up and down as in FIG. 2, wherein the cover of the ladle for receiving the molten metal is removed and the ladle is moved up.

Below, a carriage 10 for receiving molten metal with a mechanism for moving a ladle up and down of an embodiment of the present invention is discussed with reference to the appended drawings. In the drawings, the same numeral or symbol is used for the elements that correspond to, or are similar to, each other. Thus duplicate descriptions are omitted. FIG. 1 is a plan view of the carriage 10 for receiving molten metal, as an embodiment of the present invention. FIGS. 2 and 3 are front views of it (viewed from the bottom in FIG. 1). In FIGS. 2 and 3 a part of a device 70 for opening a cover, which is shown in FIG. 1, is omitted. The carriage 10 moves a ladle A up and down, which ladle A receives molten metal from a furnace, such as a melting furnace or a holding furnace (in this embodiment, a melting furnace), and transports it along a route. FIG. 2 shows the ladle A that is moved down and FIG. 3 shows one that is moved up. In FIG. 3 a cover B for the ladle A is removed. The melting furnace C (see FIG. 9), which pours molten metal into the ladle A, is located outside of FIG. 1 and at the top thereof.

The carriage 10 comprises a carriage 20 for travelling that travels on the route L. It also comprises guiding columns 30 that are disposed on the carriage 20. It also comprises a frame 40 for moving up and down that horizontally extends from the guiding columns 30 and that moves up and down above the carriage 20. It also comprises a mechanism 50 for moving a ladle that is disposed on the frame 40 and that horizontally moves the ladle A. It also comprises a driver 60 for moving the frame 40 up and down. It also comprises a device 70 for opening the cover and power-receiving equipment 80.

The carriage 20 typically travels on a rail L as the route by means of wheels 24. However, it is not limited to this, but may travel on a flat passage by means of tires. In this case, the passage is the route L. The carriage 20 has a body 22. The body 22 is typically a structure that has a flat and rectangular upper surface. The guiding columns 30, the frame 40, the mechanism 50 for moving the ladle, the driver 60 for the frame, the device 70 for opening the cover, and the power-receiving equipment 80, are placed on that surface. An opening for discharging molten metal that may leak from the ladle is preferably formed on the upper surface of the body 22, especially at a location where the ladle A is placed. If the opening is formed, molten metal that leaks from the ladle A can be discharged from the carriage 20 without remaining there, even if leakage through the bottom of the ladle A were to happen. The carriage 20 has four or more wheels 24. It also has on the body 22 a device 26 for causing the carriage to travel that drives some of the wheels 24. On the body 22, the device 26 for causing the carriage to travel is disposed at a location that is away from the frame 40, which is discussed below. Specifically, it is disposed at a side that is opposite the frame 40 with respect to the guiding columns 30.

The guiding columns 30 are a pair of columns that are disposed on the body 22 of the carriage 20. The number of columns of the guiding columns 30 is not limited to two, but may be one or three or more. The pair of the guiding columns 30 are disposed opposite, in the width direction, the carriage 10. The guiding columns 30 have high stiffness so as not to be deformed when the weight of the ladle A with molten metal is applied to them, as discussed below. They are solidly fixed to the upper surface of the body 22. A guiding device 32 for the rollers is provided to each of the guiding columns 30. It has two vertical planes that are parallel and opposite each other in the travelling direction of the carriage 20. Holding rollers 44 of the frame 40, which are discussed below, move up and down on the two parallel and vertical planes. The guiding device 32 has high stiffness so as not to be deformed when the weight of the ladle A with molten metal is applied to it, as discussed below. For example, the guiding device 32 for the rollers may be structured by a channel steel that is vertically placed. Alternatively, it may be structured by fixing two flat plates on the guiding column 30. Since the holding rollers 44, which are disposed to be vertically separate, roll on the two vertical planes of the guiding device 32, the moment that is generated in the frame 40 can be supported so as to guide the frame 40 to move up and down.

Figure 4:
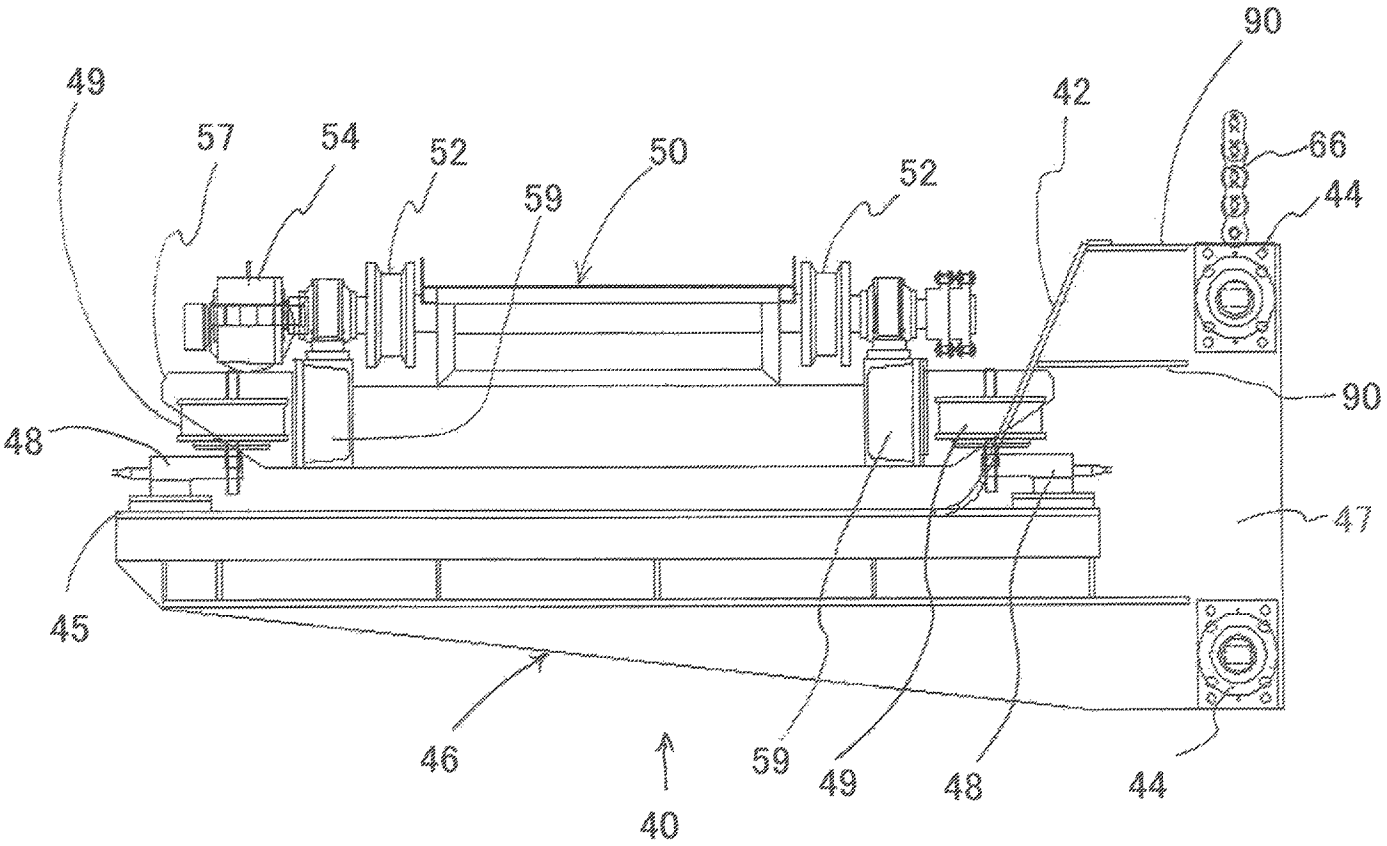
FIG. 4 is a front view of the frame for moving up and down of the carriage for receiving the molten metal with a mechanism for moving the ladle up and down of the present invention.
Figure 5:
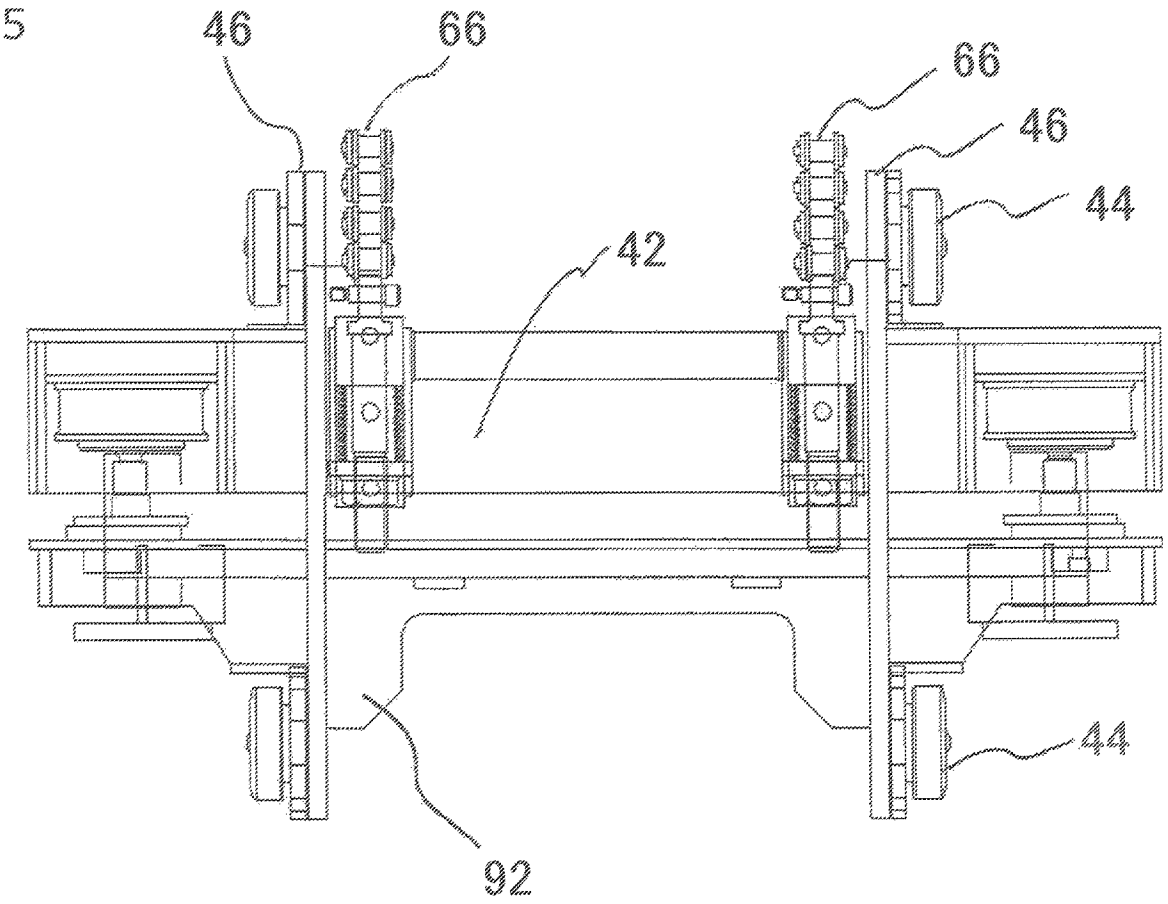
FIG. 5 is a side view of the frame for moving up and down of the carriage for receiving the molten metal with a mechanism for moving the ladle up and down of the present invention.
Figure 6:
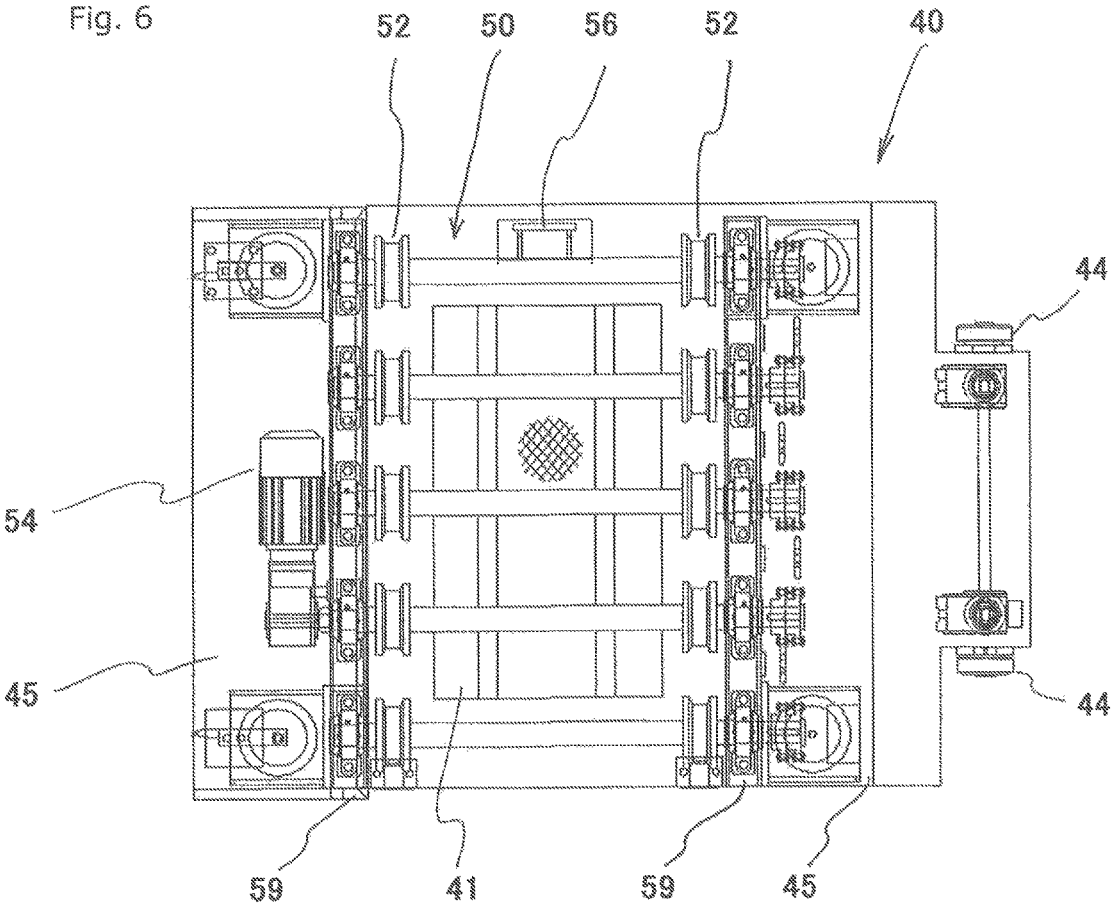
FIG. 6 is a plan view of the frame for moving up and down of the carriage for receiving the molten metal with a mechanism for moving the ladle up and down of the present invention.

Now, the frame 40 is discussed with further reference to FIGS. 4, 5, and 6. FIGS. 4, 5, and 6 are a front view, a side view (viewed from a side of the driver 60 in the travelling direction of the carriage 20), and a plan view of the frame 40 and the mechanism 50 for moving the ladle, respectively. A chain 66 may be shown in FIGS. 4, 5, and 6. The frame 40 has an arm 46 for moving up and down that horizontally and in the travelling direction of the carriage 20 extends from the guiding columns 30. The arm 46 is structured so as to support the weight of the ladle A that has received molten metal. For example, the arm 46 has a pair of arm-members 47. Each of the arm-members 47 (a plate such as a steel plate) has a member that is very wide or very high at the base, i.e., near the guiding columns 30, and becomes smaller toward the tip and has stiffeners that reinforce the arm-members 47. The bases, namely, the proximal ends, of the arm-members 47 of the arm 46 are combined with the guiding columns 30. For example, they are coupled by means of coupling members 42 for the bases. The coupling members 42 may be plates that fix the proximal ends of the pair of the arm-members 47. At the bases, which are high, the arm-members 47 are preferably coupled by a reinforcing plate 90 that is horizontal, for reinforcement. Further, they are preferably coupled by a reinforcing plate 92 that is vertical, for reinforcement. The holding rollers 44 are provided at the bases of the pair of the arm-members 47. They are disposed to be vertically separate. The holding rollers 44 roll on the two parallel planes of the guiding device 32 to move up and down. A pair of the holding rollers 44, which rollers are disposed to be vertically separate, are provided to be horizontally opposite each other. Namely, four of the holding rollers 44 are provided. The holding rollers 44 convert the moment that is generated by the weight of the ladle A, etc., to forces to press the guiding device 32 by them. Since the parts near the bases of the arm-members 47 are structured to be large, they are not deformed when the moment is applied. Thus the weight is transmitted to the holding rollers 44. In the embodiment of FIG. 5, the chain 66 is connected to the coupling members 42 to suspend the frame 40. The chain 66 is preferably connected near a position where the coupling members 42 connect the arm-members 47.

An upper plate 45 is fixed on the upper surfaces of the arm-members 47. The part near the tip of the upper plate 45 connects the tips of the arm-members 47 together to function as a coupling member for the tips. The upper plate 45 may be structured to be integrated with the coupling members 42 for the bases. For example, as in FIG. 6, an opening 41 may be formed at a part of the upper plate 45 on which the ladle A is placed. Instead of the opening 41 a plurality of small holes may be formed. If the opening 41 is formed in the part of the upper plate 45, on which the ladle A is placed, leaked molten metal falls from the arm 46 onto the carriage 20, even if leakage through the bottom of the ladle A were to happen. Thus molten metal is prevented from scattering from the arm 46 that is at a high position. Further, an opening for discharging molten metal that leaks from the ladle A is formed on the upper surface of the body 22 of the carriage 20. Thus, even if molten metal were to drop on the carriage 20, it would be discharged from the carriage 20. The arm-members 47, the coupling members 42 for the bases, and the upper plate 45, may be structured to be integrated by combining steel plates and shaped steels. Or, they may be structured by combining members or shaped steels and then by joining them. Since the frame 40 is supported at the base (near the guiding columns 30) like a cantilever (supported at the right side in FIG. 4), the moment that is generated there is received by the holding rollers 44 and the guiding device 32. Thus moving the frame up and down can be achieved by a simple structure and in a condition to allow measures against leakage of molten metal to be taken.

The frame 40 has a load cell 48 to measure the weight of the ladle A. The load cell 48 is typically disposed between the arm 46 for moving up and down and the mechanism 50 for horizontally moving the ladle. It measures the weight of the mechanism 50 for moving the ladle and the ladle A. Since the ladle A becomes hot when it receives molten metal, it is preferable not to place the load cell 48 just under the ladle A. Thus the weight is measured through the mechanism 50 for moving the ladle that supports the ladle A that has received molten metal. Depending on the structure of the mechanism 50 for moving the ladle, the load cell 48 may be placed on the mechanism 50 for moving the ladle. Typically, the load cells 48 are provided to both ends of two horizontal beams 59 that support the mechanism 50 for moving the ladle. Thus four of the load cells 48 in total are provided.

In this embodiment, the roller conveyor 52 that is located on the frame 40 is used for the mechanism 50 for moving the ladle. The roller conveyor 52 moves the ladle A that is placed on it to the direction perpendicular to the travelling direction of the carriage 20. Both ends of the roller conveyor 52 are supported by the pair of the horizontal beams 59. The distance between the horizontal beams 59 is less than the distance between the positions of the mechanism 50 for moving the ladle being supported by the frame 40 (for example, the positions of the load cells 48) in the travelling direction of the carriage 20 (the lateral direction in FIG. 4). Namely, the roller conveyor 52 is supported in a condition wherein the width becomes greater at a lower position. Thus, when the ladle A moves on the roller conveyor 52, just a little shaking occurs, so that it is stable. Further, a rubber-made buffer 49 is preferably inserted between the mechanism 50 for moving the ladle and the load cell 48 as in FIG. 4 so that just a little shaking occurs when the ladle A moves. A driver 54 for the roller conveyor that drives the roller conveyor 52 is provided on a rib 57 that is fixed to one of the horizontal beams 59. The driver 54 for the roller conveyor is disposed not under the ladle A, but at a position that is horizontally away from the position under the ladle A. Further, a cover for the driver 55 preferably covers the driver 54 for the roller conveyor at the upper part and the side part that is near the roller conveyor 52, so that no molten metal would drop on the driver 54 even if leakage through the bottom of the ladle A were to happen. Further, a carriage stop 56 is provided near the melting furnace C from the ladle A (the top in FIG. 6) to prevent the ladle A that is moved, by the mechanism 50 for moving the ladle, from dropping. An anti-drop stop (not shown) is preferably provided at a side that is opposite the melting furnace C (the bottom in FIG. 6). The carriage stop 56 and the anti-drop stop may be plate-shaped or bar-shaped projections, on which the ladle A hits, to thereby be stopped when it is moved on the roller conveyor 52.

The driver 60 for the frame moves the frame 40 up and down. The driver 60 has a motor 62 for moving the frame up and down. It also has a sprocket 64 that is connected to the output shaft of the motor 62. It also has an upper chain wheel 68 that is suspended by the guiding columns 30 above the guiding device 32. It also has a chain 66 that loops around the sprocket 64 and the frame 40 via the upper chain wheel 68. The sprocket 64 may be connected to the motor 62 so that a reducer or another mechanism is provided between it and the output shaft of the motor 62. Two sets of the sprocket 64, the chain 66, and the upper chain wheel 68 are preferably provided so that two chains 66 are connected to the frame 40. The motor 62 and the sprocket 64 are disposed at a side that is opposite the frame 40 with respect to the guiding columns 30 on the body 22 of the carriage 20. Namely, they are disposed to be horizontally away from the frame 40.

The motor 62 is disposed above the upper surface of the body 22 of the carriage 20. For example, as in FIG. 2, it is disposed above the bottom of the ladle A when the frame 40 is lowered. In this embodiment, it is disposed on a gear box 63, i.e., the reducer, so as to be disposed above the bottom of the ladle A.

Figure 7:
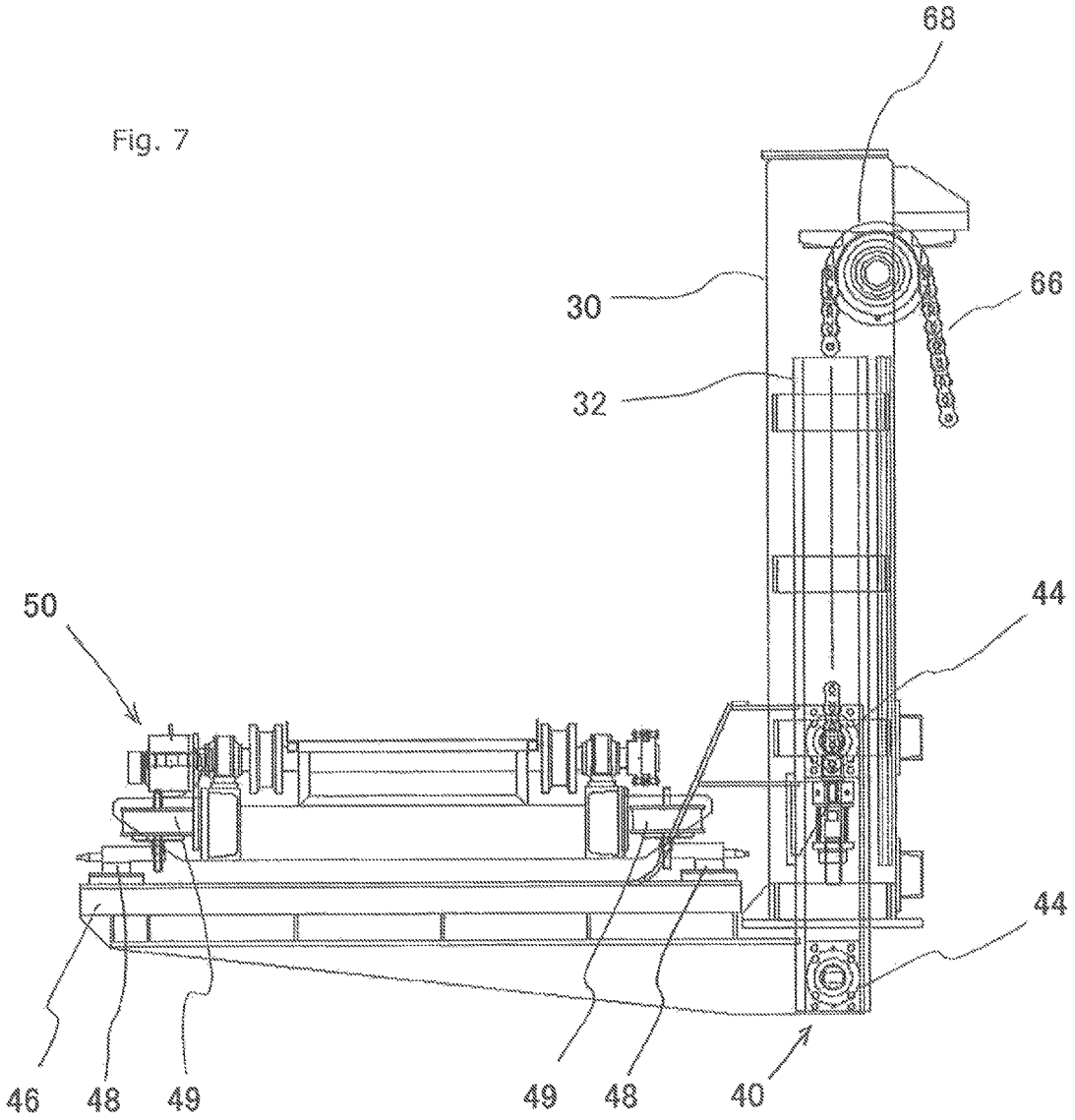
FIG. 7 is a front view of the frame for moving up and down and the guiding columns of the carriage for receiving the molten metal with a mechanism for moving the ladle up and down of the present invention.
Figure 8:
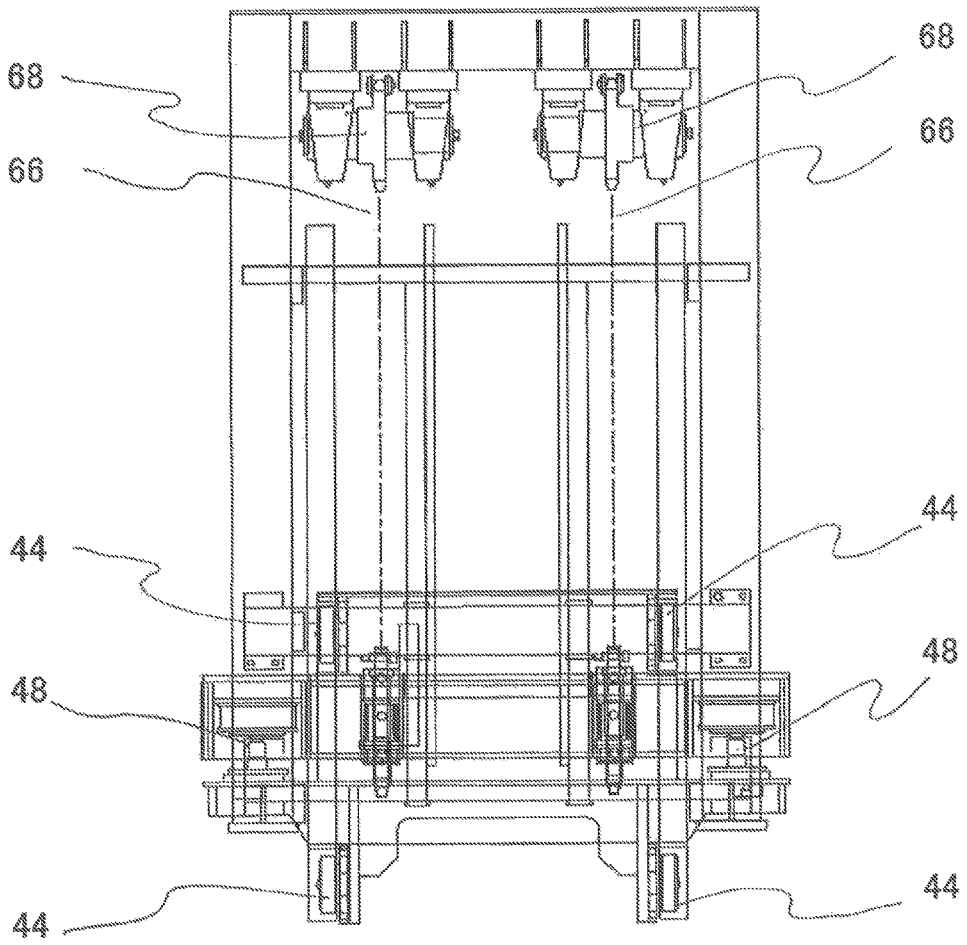
FIG. 8 is a schematic side view of the structure to move up and down the frame for moving up and down of the carriage for receiving the molten metal with a mechanism for moving the ladle up and down of the present invention.

Now, the way to move the ladle A up and down is discussed with further reference to FIGS. 7 and 8. FIG. 7 is a front view of the guiding columns 30 and the frame 40. FIG. 8 is a schematic side view (viewed from the right in FIG. 1) that illustrates a structure to move the frame 40 up and down. As in FIG. 8, the base of the frame 40 is suspended by two chains 66. As in FIG. 2, the chain 66 loops around the sprocket 64 of the driver 60 for the frame and the frame 40 via the upper chain wheel 68. The rotation of the sprocket 64 causes the frame 40 to move up and down. Since the frame 40 is suspended by two chains 66, no tilt of the frame 40 in the width direction of the carriage 10 for receiving molten metal occurs, so as to stably move up and down. Further, in the travelling direction of the carriage 10, since the upper and lower holding rollers 44 roll on the two parallel flat planes, any tilt of the frame 40 is prevented. That is, the weight of the ladle A that has received molten metal, the mechanism 50 for moving the ladle, the arm 46 for moving up and down, and so on, is transmitted from the arm-members 47 to the two chains 66 to be supported. The moment that is generated at the bases of the arm-members 47 is converted to the force of the holding rollers 44, which are vertically separated from each other, pressing the two flat planes of the guiding device 32 for the rollers. Thus a large moment can be without any difficulty supported by increasing the vertical distance between the holding rollers 44. In this way the heavy ladle A can be moved up and down by means of the frame 40, the guiding columns 30, and the driver 60.

The device 70 for opening the cover has a column 72 that is fixed on the body 22 of the carriage 20. It also has a motor 78 for the cover that is provided on the top of the column 72. It also has an arm 74 that horizontally extends and that swivels by means of the output shaft of the motor 78. It also has a device 76 for grasping the cover that is provided at the tip of the arm 74. Since the column 72 causes the arm 74 and the device 76 for grasping the cover to be located at a high position, the device 76 can grasp the cover B of the ladle A that is positioned above the frame 40. Namely, for example, as in FIG. 3, the column 72 is so tall that the top of it is at the same height as the cover B of the ladle A when the ladle A is elevated. The device 76 for grasping the cover has a grasping member 77 that is hook-shaped. The grasping member 77 slides under a top panel B11 of a T-shaped member B that is attached to the top of the cover B. The device 76 also has a vertical cylinder 79 that moves the grasping member 77 up and down. To grasp the cover B, the device 76 for grasping the cover is moved to a location that is away from a location above the ladle A. Then the height of the grasping member 77 is adjusted to the height of the T-shaped member B by means of the vertical cylinder 79. Then the arm 74 is swiveled by means of the motor 78 so that the grasping member 77 slides under the top panel B11 of the T-shaped member B. Then the device 76 for grasping the cover is elevated by means of the vertical cylinder 79 so that the grasping member 77 grasps the top panel B11. The device 76 is further elevated so that the cover B is lifted off the ladle A. Then, the arm 74 is swiveled so as to move the cover B from a location above the ladle A.

The power-receiving equipment 80 has a rack 82 that is provided on the carriage 20. It also has a trolley pole 84 that is provided on the rack 82. It also has a trolley wheel 86 that is provided at the tip of the trolley pole 84 and receives power from a power line. It also has cables (not shown). Since the carriage 10 receives power while it moves along the route L in the foundry, it receives power through the trolley wheel 86 from the power line W (see FIG. 9) that is strung along the route L. The power line W is highly strung so as not to obstruct the movement of personnel and any object in the foundry and so as not to interfere with any other devices. Thus the trolley wheel 86 is highly placed by means of the rack 82 and the trolley pole 84. Further, even if the power line W is somewhat misaligned with the rail L, the trolley wheel 86 contacts the power line W because of the flexibility of the trolley pole 84. The power-receiving equipment 80 may have some other structure. For example, it may be a device for receiving a cable that is wound around a cable reel on a rack. Alternatively, when the carriage 10 travels only a short distance, it may have a cableveyor to receive power from an external power source.

Figure 9:
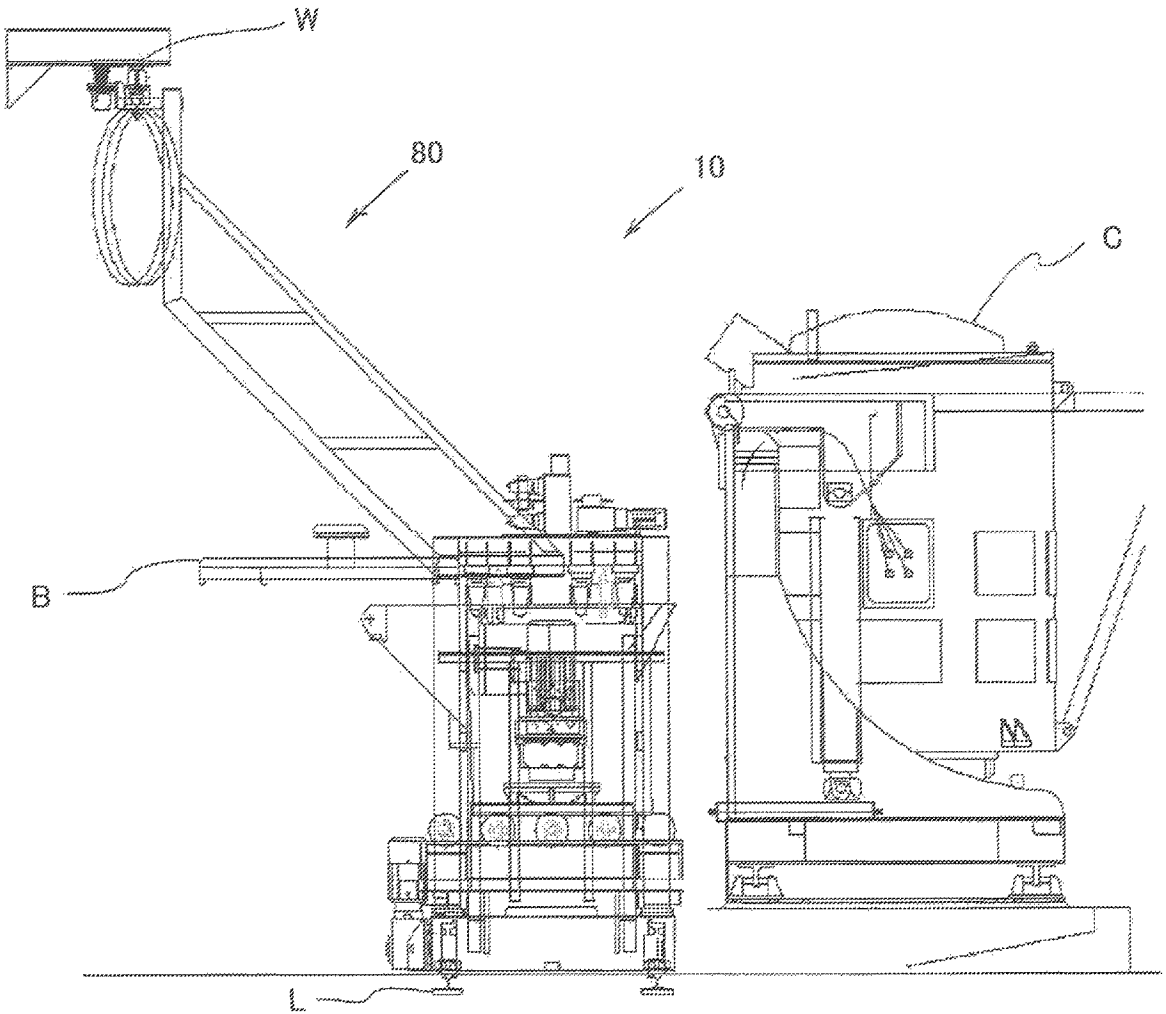
FIG. 9 is a side view illustrating the positional relationship between the melting furnace and the power-receiving equipment of the carriage for receiving the molten metal with a mechanism for moving the ladle up and down of the present invention.

As in FIG. 9, the power-receiving equipment 80 is located opposite the melting furnace C with respect to the route L. Namely, the power line W is also located opposite the melting furnace C with respect to the route L. FIG. 9 is a side view (viewed from the right in FIG. 1) that illustrates the positional relationship between the power-receiving equipment 80 and the melting furnace C. As in FIG. 2, the power-receiving equipment 80 is disposed opposite the frame 40 with respect to the guiding columns 30 that are on the carriage 20.

Figure 10:
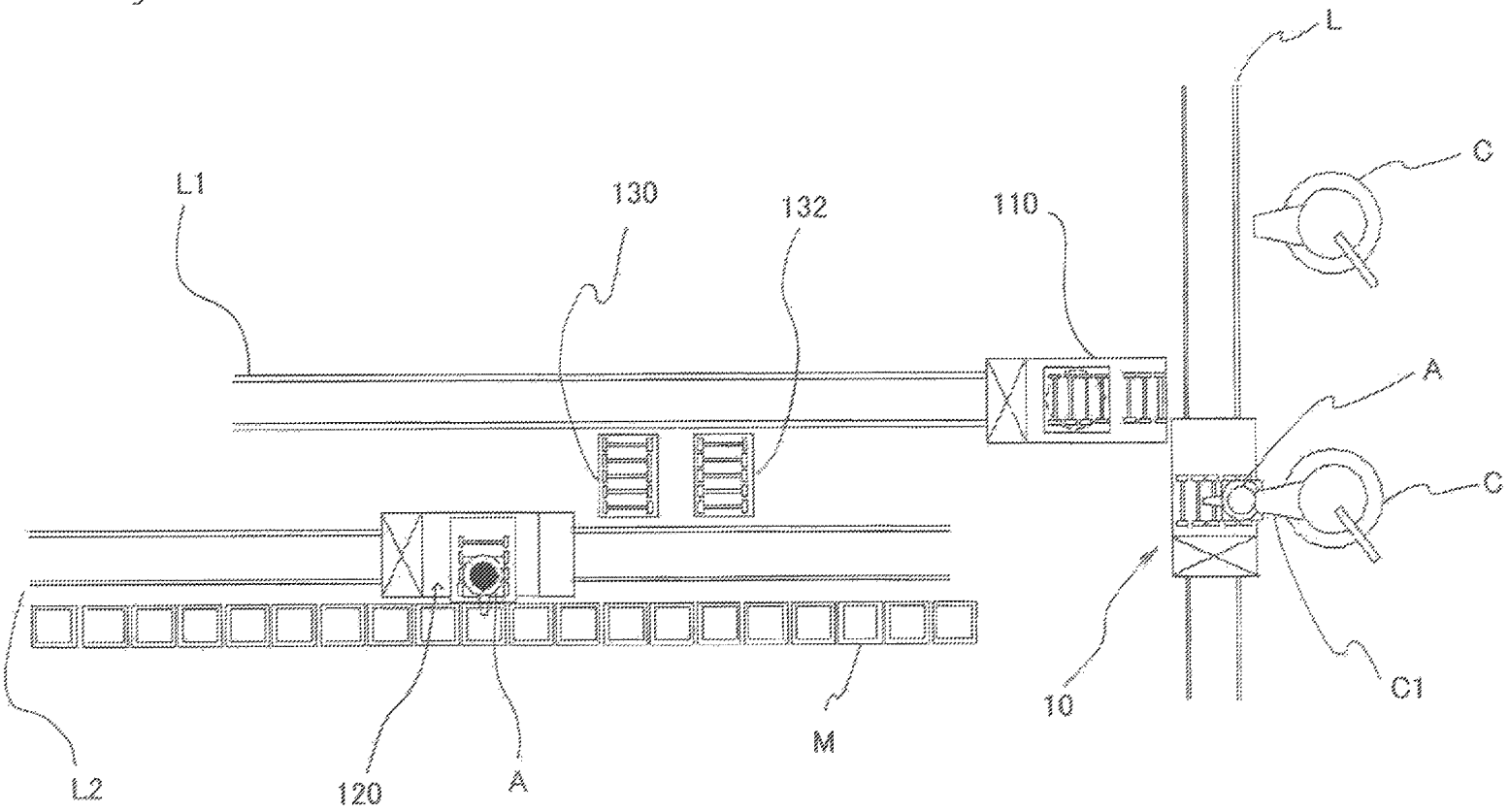
FIG. 10 is a plan view illustrating an exemplary layout of the devices of a foundry.

Now, the function of the carriage 10 for receiving the molten metal with a mechanism for moving the ladle up and down is discussed with further reference to FIG. 10. FIG. 10 is a plan view that illustrates an exemplary layout of the devices in the foundry. In the foundry as in FIG. 10 molten metal that has been melted by the melting furnace C is transported by means of the ladle A and is poured into molds M. Two melting furnaces C are disposed along the rail L. The carriage 10 travels on the rail L. A rail L1 for transferring is laid perpendicular to the rail L. A carriage 110 for transferring travels on the rail L1 for transferring. A rail L2 for pouring is laid in parallel to the rail L1 for transferring. An automatic pouring machine 120 travels on the rail L2 for pouring. The rail L2 for pouring is laid along a line of the molds M. A conveyor 130 for a filled ladle, which transfers the ladle A that contains molten metal, and a conveyor 132 for the empty ladle, which transfers the ladle A that is empty, are laid between the rail L1 for transferring and the rail L2 for pouring.

First, a step of pouring molten metal from the melting furnace C into the ladle A is discussed. The carriage 10 that carries an empty ladle A moves to a predetermined position to receive molten metal in front of the melting furnace C, namely, the position where molten metal can be poured from the melting furnace C into the ladle A. The carriage 20 is preferably equipped with an encoder 28 (see FIG. 1) at the wheel 24 so as to stop the carriage 10 at the predetermined position. The empty ladle A is covered with a cover B. In the carriage 10, the frame 40 is elevated so that the ladle A is at a height that is suitable to receive molten metal from the melting furnace C (see FIGS. 2 and 3). The frame 40 or the driver 60 for the frame is preferably equipped with an encoder (not shown) to accurately control the height of the ladle. The motor 62 is preferably equipped with an inverter to control the rate of elevation. The ladle A is moved near the melting furnace C by means of the mechanism 50 for moving the ladle. That is, it is moved to a location that is suitable to receive molten metal from the melting furnace C. The roller conveyor 52 is also preferably equipped with an encoder (not shown) to accurately control the distance between the melting furnace C and the ladle A. The driver 54 for the roller conveyor is preferably equipped with an inverter to control the rate of moving the ladle A that is moved by means of the mechanism 50 for moving the ladle. Since the mechanism 50 for moving the ladle is provided to the frame 40, the ladle A can be moved to a location that is suitable to receive molten metal from the melting furnace C while it is elevated. Thus the time to complete the process can be reduced.

After the ladle A is elevated by means of the frame 40, the device 70 for opening the cover lifts the cover B off the ladle A. The arm 74 swivels so as to move the cover B from a location above the ladle A (see FIG. 1). Since the cover B is lifted after the ladle A is elevated, the distance to move the grasping member 77 up and down by means of the vertical cylinder 79 is reduced. Thus the device 76 for grasping the cover can be made small. Since the device 76 for grasping the cover is made small and light, the arm 74 and the motor 78 can be made small, resulting in the small device 70 for opening the cover. Further, since the arm 74 swivels so as to move the cover B from a location above the ladle A, the cover does not impede the melting furnace C from pouring molten metal into the ladle A.

After the ladle A is moved to a predetermined location and height and the cover B is removed, a predetermined amount of molten metal is poured from the melting furnace C into the ladle A. Since molten metal is poured while the weight of the ladle A, i.e., the weight of the received molten metal, is measured by means of the load cell 48, an accurate amount of the molten metal can be poured into the ladle A. Especially, since the weight other than the molten metal, which weight is measured by the load cell 48, is small, the weight can be accurately measured. When molten metal is poured from the melting furnace C into the ladle A, the angle to tilt the melting furnace C, i.e., the tilting angle, is changed depending on the amount of molten metal in the melting furnace C. When the tilting angle is changed, the position of a tapping hole C1 of the melting furnace C, from which molten metal is poured, is changed. The length of a cylinder (not shown) to tilt the melting furnace C, the inclination of a reference plane by which the tilt of the melting furnace C is measured, or the rotation of a shaft that supports the melting furnace C, namely, the tilt of the melting furnace C, is measured so that the position toward which molten metal flows is estimated. Thus the ladle A is moved by means of the mechanism 50 for moving the ladle on the frame 40 to be close to, or away from, the melting furnace C, so that the molten metal flows to that position. That is, the distance from the melting furnace C to the ladle A is to be changed. Alternatively, the height of the ladle A is to be changed by means of the frame 40, depending on the height of the tapping hole C1 of the melting furnace C. By changing the distance or the height, molten metal is caused to flow to the desired position in the ladle A.

The melting furnace C generally has a capacity of the molten metal to pour into the ladle A for four or five cycles. Thus the tilting angle may be simply estimated based on the cycle of pouring. Since the tilting angle of the melting furnace C is changed based on the cycle of pouring, the height of the ladle A or the distance from the melting furnace C to the ladle A is accordingly to be changed so that the correct amount of molten metal is poured into the ladle A. By changing both the height and distance, molten metal is more correctly poured into the ladle A. Precisely, when molten metal is being poured from the melting furnace C into the ladle A, the amount of molten metal that remains in the ladle A decreases. Thus the tilting angle is preferably increased. Based on that tilting angle, the height of the ladle A or the distance from the melting furnace C to the ladle A or both are preferably changed so that the correct amount of molten metal is poured into the ladle A. By the aforementioned control, molten metal is caused to flow to the desired position in the ladle A regardless of the amount of it in the melting furnace C. Incidentally, when a pocket is formed in the ladle A to place an alloying element, molten metal is prevented from directly flowing to that pocket. This is a great advantage.

After the ladle A receives molten metal, the device 70 for opening the cover returns the cover B to put it on the ladle A. The operation to return the cover B is preferably initiated based on a signal that detects the end of pouring from the melting furnace C. In this way, since the cover B of the ladle A is removed and returned by means of the device 70 for opening the cover, the period from receiving molten metal to putting the cover B on the ladle A is shortened, so that the insulation effect is enhanced.

After returning the cover B to put it on the ladle A, the frame 40 is moved down so that the ladle A is lowered (see FIG. 2). Further, the ladle A is moved backward so as to be away from the melting furnace C, by means of the mechanism 50 for moving the ladle. Generally, the ladle A is located at the center of the carriage 20 in the width direction. Since the ladle A is at the lower position and the center, the carriage 10 stably moves and the shaking of the ladle A is reduced. The carriage 10 is moved from the front of the melting furnace C to the front of the rail L1 for transferring. The operation to move the carriage 10 is preferably initiated based on a signal that detects the end of moving the ladle A to the predetermined height and location. Incidentally, the device 26 for causing the carriage to travel is preferably equipped with an inverter so that the carriage 10 is smoothly accelerated and decelerated.

While the ladle A is moved from the front of the melting furnace C to the front of the rail L1 for transferring, slag in the molten metal in the ladle A may be removed. Since the carriage 10 has the device 70 for opening the cover, the cover B can be removed from the ladle A to remove slag at any location. Further, the ladle A can be elevated by means of the frame 40 to a height that is suitable to remove slag. Thus the operation to remove slag is facilitated.

After the carriage 10 is moved to the front of the rail L1 for transferring, the frame 40 is elevated so that the height of the mechanism 50 for moving the ladle fits that of the carriage 110 for transferring. Then, the ladle A is transferred to the carriage 110 for transferring by means of the mechanism 50 for moving the ladle. Since the height of the mechanism 50 for moving the ladle can be elevated to fit that of the carriage 110 for transferring by the carriage 10, the ladle A can be smoothly transferred to the carriage 110 for transferring or the automatic pouring machine 120, even when their heights do not match each other.

In the carriage 10 the motor 62 of the driver 60 for the frame is disposed opposite the frame 40 with respect to the guiding columns 30, on the body 22 of the carriage 20. That is, it is horizontally disposed away from the frame 40. Thus, even if molten metal were to leak from the ladle A, the motor 62 would be prevented from being damaged. Since no motor 62, which takes a long time to be repaired, is damaged, any repairs can be easily carried out. Further, the motor 62 is located higher than the bottom of the ladle A when the frame 40 is lowered. The motor 78 is located on the top of the column 72, which is higher than the bottom of the ladle A even when the frame 40 is elevated. Thus both of the motors 62, 78 are located higher than the bottom of the ladle A when the carriage 10 moves, namely, when the frame 40 is lowered. Thus the motors 62, 78 would be prevented from being damaged, even if molten metal were to leak from the ladle A. Since the motors 62, 78, which take a long time to be repaired, are prevented from being damaged, any repairs can be easily carried out. Incidentally, the leakage of molten metal generally occurs at the bottom of the ladle when a refractory on the inner surface of a ladle deteriorates.

As in FIG. 2, the device 26 for causing the carriage to travel of the carriage 20 is disposed next to the driver 60 for the frame. Since it is located away from the frame 40, namely, away from the ladle A, the device 26 would be prevented from being damaged, even if molten metal were to leak from the ladle A. Since the device 26, which includes an electric system, which takes a long time to be repaired, is prevented from being damaged, any repairs can be easily carried out. If an opening is formed on the upper surface of the body 22, especially on the horizontal part on which the ladle A is placed, if molten metal were to leak from the ladle A it would quickly flow out through the opening. Thus the other devices can be prevented from being damaged.

Further, when a cover for the driver is placed between the driver 54 and the ladle A, the driver 54 would be prevented from being damaged, even if molten metal were to leak from the ladle A. Since the driver 54, which includes an electric system, which takes a long time to be repaired, is prevented from being damaged, any repairs can be easily carried out.

In this way, in the carriage 10 devices are prevented from being damaged and any repairs can be easily carried out, even if molten metal were to leak from the ladle A. Thus it is highly reliable.

As in FIG. 2, the driver 54 for the roller conveyor of the mechanism 50 for moving the ladle is located below the bottom of the ladle A. However, it is located outside the roller conveyor 52, in its axial direction, namely, away from the part directly under the ladle A. Molten metal would generally flow through the roller conveyor 52, if it were to leak from the ladle A. Thus the driver 54 for the roller conveyor would be prevented from being damaged. Further, as in FIG. 1, the encoder 28 of the carriage 20 is preferably located opposite the melting furnace C so as not to be damaged by its heat.

Further, since the power-receiving equipment 80 is located opposite the melting furnace C with respect to the route L, it is not damaged by heat. Especially, since electric systems, including cables, are sensitive to heat, they are preferably located so as not to be damaged by the heat.

After the ladle A is transferred to the carriage 110 for transferring, the carriage 110 moves to the front of the conveyor 130 for the filled ladle. There the ladle A is transferred to the conveyor 130 for the filled ladle. The ladle A is transported to the rail L2 for pouring by means of the conveyor 130 for the filled ladle to be transferred to the automatic pouring machine 120. The automatic pouring machine 120 moves to the front of a predetermined mold M to pour molten metal from the ladle A into it. The molds on the line are moved by one step, which step is one length of a mold, and the automatic pouring machine 120 may also move on the rail L2 for pouring, if necessary, to pour molten metal from the ladle A into the molds M one by one. The automatic pouring machine 120 is preferably equipped with a device for opening the cover so that the cover B is removed while pouring is being carried out.

After the pouring of molten metal from the ladle A finishes, the automatic pouring machine 120 moves to the front of the conveyor 132 for the empty ladle. The ladle A, which is empty, is transferred to the conveyor 132 for the empty ladle. The ladle A that has been transferred to the conveyor 132 for the empty ladle is transferred to the carriage 110 for transferring that stays in the front of the conveyor 132. The carriage 110 for transferring transfers the empty ladle A to the carriage 10 for receiving the molten metal with a mechanism for moving the ladle up and down. The carriage 10 that carries the empty ladle A moves to the front of the melting furnace C. Then molten metal is poured from the melting furnace C into the ladle A. In this way molten metal is transported from the melting furnace C by means of the ladle A to pour into the molds M.

Incidentally, a plurality of ladles A are preferably used. In this case, immediately after a ladle A that stores molten metal is transferred to the conveyor 130 for the filled ladle by means of the carriage 110 for transferring, the carriage 110 moves to the front of the conveyor 132 for the empty ladle to receive an empty ladle A. Then the carriage 110 moves to the melting furnace C so that molten metal is poured into the ladle A.

Thus, by the carriage 10 for receiving the molten metal with a mechanism for moving the ladle up and down of the present invention, a ladle for receiving the molten metal is safely moved up and down and transported. Further, the operation is reliable. Further, even if molten metal were to leak from the ladle, any repairs can be easily carried out.

In the carriage 10 for receiving molten metal with a mechanism for moving a ladle up and down, the mechanism 50 for moving the ladle has the roller conveyor 52, as discussed above. However, a mechanism for moving the ladle may be structured by a rail that is laid on the frame 40 and a carriage that travels on the rail. Since the travel by the mechanism for moving the ladle is short, using the roller conveyor 52 is beneficial, as it is light and economical.

In the carriage 10 for receiving molten metal with a mechanism for moving a ladle up and down, the frame 40 is moved up and down by the driver 60 for the frame, namely, the chain 66 that is driven by the sprocket 64 and is moved with the upper chain wheel 68, as discussed above. However, instead of the chain 66 a wire rope and pulleys may be used. Alternatively, any means to move the frame 40 up and down, such as a ball screw or a pantograph, may be used. If the frame 40 is suspended by means of the chain or the wire rope, nothing needs to be placed under it. That is, since nothing is placed under the ladle A that stores molten metal, the driver for the frame would be prevented from being damaged, even if molten metal were to leak from the ladle A. Incidentally, two chains 66 are used as discussed above. However, the number of chains is not limited to two.

Molten metal is poured from the melting furnace C into the ladle A, as discussed above. However, it may be poured from any type of furnace, such as a holding furnace. The ladle A is transferred from the carriage 10 to the carriage 110 for transferring, as discussed above. However, the ladle A may be transferred from the carriage 10 directly to the automatic pouring machine 120 or through some other device. The embodiment of FIG. 10 has just one pouring line (one line of molds, one automatic pouring machine 120, and one rail L2 for pouring). However, any element of the pouring line may be plural. For example, multiple carriages 110 for transferring, or multiple rails L1, may be used.

Below, the main reference numerals and symbols that are used in the detailed description and drawings are listed.

10 the carriage for receiving molten metal with a mechanism for moving a ladle up and down
20 the carriage
22 the body
24 the wheel
26 the device for causing the carriage to travel
28 the encoder
30 the guiding columns
32 the guiding device for the rollers
40 the frame for moving up and down
41 the opening
42 the coupling members for the bases
44 the holding rollers
45 the upper plate
46 the arm for moving up and down
47 the arm-members

48 the load cell
49 the rubber-made buffer
50 the mechanism for moving the ladle
52 the roller conveyor
55 the cover for the driver
56 the carriage stop
57 the rib
59 the cover for the driver
60 the driver for moving the frame up and down, i.e., the driver for the frame
62 the motor for moving the frame up and down
63 the gear box
64 the sprocket
66 the chain
68 the upper chain wheel
70 the device for opening the cover
72 the column
74 the arm
76 the device for grasping a cover
77 the grasping member
78 the motor for the cover
79 the vertical cylinder
80 the power-receiving equipment
82 the rack
84 the trolley pole
86 the trolley wheel
90 the reinforcing plate (the horizontal plate for reinforcement)
92 the reinforcing plate (the vertical plate for reinforcement)
110 the carriage for transferring
120 the automatic pouring machine
130 the conveyor for the filled ladle
132 the conveyor for the empty ladle
A the ladle
B the cover
B1 the T-shaped member
B11 the top panel
C the melting furnace (the furnace)
C1 the tapping hole
L the rail (the route)
L1 the rail for the carriage for transferring
L2 the rail for the automatic pouring machine
M the molds
W the power line

The invention claimed is:

1. A carriage for receiving molten metal with a mechanism for moving a ladle up and down, wherein the carriage for receiving molten metal transports the ladle for receiving molten metal, the carriage for receiving molten metal comprising:

a carriage for travelling on a route;

guiding columns that are placed on the carriage for travelling;

a frame for moving the ladle up and down that horizontally extends from the guiding columns and that moves up and down above the carriage for travelling;

a mechanism for moving the ladle, which mechanism is placed on the frame and horizontally moves the ladle; and a driver for moving the frame up and down, wherein the frame has an arm for moving up and down and two holding rollers, wherein the mechanism for moving the ladle is placed on the arm for moving up and down, wherein the arm for moving up and down horizontally extends and is taller near the guiding columns, wherein the two holding rollers are disposed with a vertical space therebetween on the arm for moving up and down near the guiding columns, and wherein a guiding device for the rollers that has a vertical surface, on which the holding rollers roll, is provided to each of the guiding columns.

2. The carriage for receiving molten metal with a mechanism for moving a ladle up and down of claim 1, wherein the frame is suspended at two locations by chains, and wherein the driver for moving the frame up and down moves the frame up and down by means of the chains.

3. The carriage for receiving molten metal with a mechanism for moving a ladle up and down of claim 2, wherein a motor of the driver for moving the frame up and down is placed at a side that is opposite the frame on the carriage for travelling with respect to the guiding columns.

4. The carriage for receiving molten metal with a mechanism for moving a ladle up and down of claim 2, wherein the frame has a load cell to measure a weight of the ladle.

5. The carriage for receiving molten metal with a mechanism for moving a ladle up and down of any of claims 2, 3, or 4, wherein a device for opening a cover is provided on the carriage for travelling, wherein the device for opening a cover has a column that is placed on the carriage for travelling, an arm that rotates about a center of the column on a top thereof, and a device for grasping a cover that is disposed at a tip of the arm.

6. The carriage for receiving molten metal with a mechanism for moving a ladle up and down of claim 5, wherein the motor of the driver for moving the frame up and down and a motor of the device for opening a cover are located above a height of the bottom of the ladle when the frame is lowered.

7. The carriage for receiving molten metal with a mechanism for moving a ladle up and down of claim 6, further comprising power-receiving equipment that receives power from outside the carriage for receiving molten metal and is located at a side that is opposite a furnace that pours molten metal into the ladle.

* * * * *